United States Patent [19]

Frost

[11] Patent Number: 4,561,494

[45] Date of Patent: Dec. 31, 1985

[54] HEAT EXCHANGER WITH BACK TO BACK TURBULATORS AND FLOW DIRECTING EMBOSSMENTS

[75] Inventor: Donald J. Frost, Racine, Wis.

[73] Assignee: Modine Manufacturing Company, Racine, Wis.

[21] Appl. No.: 489,705

[22] Filed: Apr. 29, 1983

[51] Int. Cl.[4] ..... F28F 3/06; F28F 9/22

[52] U.S. Cl. ..... 165/76; 165/167; 165/109.1

[58] Field of Search ..... 165/109 T, 173, 175, 165/165, 166, 167, 149, 157, 158, 76; 220/67

[56] References Cited

U.S. PATENT DOCUMENTS

| | | | |
|---|---|---|---|
| 1,736,906 | 11/1929 | Flintermann | 165/175 |
| 2,360,123 | 10/1944 | Gerstung et al. | 165/109 T |
| 2,511,084 | 6/1950 | Shaw | 165/157 |
| 3,139,131 | 6/1964 | Hutchinson | 220/67 |
| 3,169,618 | 2/1965 | Wilkinson | 220/67 |
| 3,206,060 | 9/1965 | Turner | 220/67 |
| 3,550,832 | 12/1970 | Fitzgerald | 220/67 |
| 3,702,021 | 11/1972 | Wolfe et al. | 29/157.3 D |
| 3,734,135 | 5/1973 | Mosier | 165/177 |
| 3,743,011 | 7/1973 | Frost | 165/38 |
| 3,795,274 | 3/1974 | Fieni | 165/149 X |
| 4,078,542 | 3/1978 | Young et al. | 165/165 |
| 4,258,785 | 3/1981 | Beldam | 165/175 |
| 4,360,055 | 11/1982 | Frost | 165/167 |

FOREIGN PATENT DOCUMENTS

| | | | |
|---|---|---|---|
| 3222278 | 12/1983 | Fed. Rep. of Germany | 165/149 |
| 2010517 | 2/1970 | France . | |

*Primary Examiner*—Sheldon J. Richter
*Assistant Examiner*—Randolph A. Smith
*Attorney, Agent, or Firm*—Wood, Dalton, Phillips, Mason & Rowe

[57] ABSTRACT

A heat exchanger for exchanging heat between two fluids including a plurality of heat exchange units in stacked relation including a housing containing the stack. The invention contemplates an improved cover construction whereby the housing may be sealed, the use of embossments in plates forming the heat exchange units at advantageous locations to eliminate spacers heretofore employed and a turbulator structure employing symmetrical fins placed in back to back relationship.

11 Claims, 8 Drawing Figures

34
146
164
64
52
54
48
70
50
58
56
60
156
150
62
40
42
44
98
96
66
72
68
102
90
86
94
80
78
82
88
84
92
38
100
140
142
148
144
160
46
152
154
A
A

HEAT EXCHANGER WITH BACK TO BACK TURBULATORS AND FLOW DIRECTING EMBOSSMENTS

FIELD OF THE INVENTION

This invention relates to a heat exchanger, and more particularly, to a heat exchanger of the type having a plurality of heat exchange units in stacked relation as used, for example, in oil coolers.

BACKGROUND ART

Prior art of possible relevance includes U.S. Pat. Nos. 3,743,011 issued July 3, 1973 and 4,360,055 issued Nov. 23, 1982, both to Frost.

Heat exchangers made according to either of the above identified patents have proved to be extremely successful, particularly in applications as cooling the lubricating oil in an internal combustion engine. The disclosed structures are relatively simple in design, inexpensive to fabricate and readily serviceable when required.

Nonetheless, it is desirable to provide additional advantages in a heat exchanger structure, including, for example, improved heat transfer characteristics, ease of fabrication, particularly by highly automated methods, decreased weight, etc. and the present invention differs from those set forth in the above identified patents in providing these and other advantages which are disclosed and claimed herein.

SUMMARY OF THE INVENTION

It is the principal object of the invention to provide a new and improved heat exchanger, and more specifically, to provide a new and improved heat exchanger of the type utilizing a plurality of heat exchange units in stacked relation, and wherein each unit comprises a pair of spaced metallic plates joined together and sealed at their peripheral edges.

According to one facet of the invention, a metallic turbulator structure is disposed between the plates and in heat exchange relation with both. At least two opposed flow openings are disposed about a center opening in each of the plates in the turbulator structure with the openings in each being in line with the corresponding openings of the other. Embossment means are provided on the plates and on the turbulator structure for (a) sealing the central opening from the opposed openings and (b) serving as baffles between the plates to direct fluid flowing from one opposed opening to the other through the turbulator structure. The exchanger is completed by a housing with appropriate inlets and outlets.

According to this facet of the invention, improved heat transfer characteristics and lesser weight advantages are achieved by elimination of oil and water spacers currently used in similar heat exchangers.

According to another facet of the invention, the turbulator structure is formed of two substantially symmetrical fins in back to back contact with each other. Each fin has a multiplicity of slit formed strands extending from the respective faces and in contact with the adjacent one of the plates. A heat exchanger embodying this facet of the invention has improved strength and heat transfer characteristics.

According to still another facet of the invention, the housing has a stack receiving opening defined by a bead. A cover member is provided for the opening and includes a peripheral groove facing the bead and having the same configuration thereof so as to be received on the bead. Means are provided for holding the cover in sealed relation on the bead as, for example, a plurality of tangs on one wall of the groove for bitingly engaging the housing about the bead.

Other objects and advantages will become apparent from the following specification taken in connection with the accompanying drawings.

DESCRIPTION OF THE PREFERRED EMBODIMENTS

Figure 1:
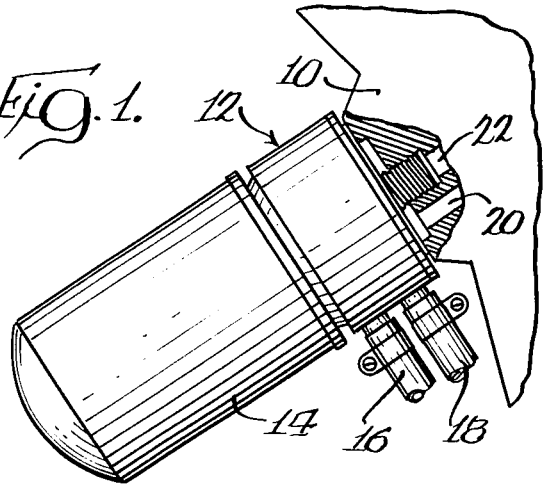
FIG. 1 is a view of a heat exchanger made according to the invention employed as an oil cooler and mounted on the block of an engine in connection with an oil filter.

An exemplary embodiment of a heat exchanger made according to the invention is illustrated in FIG. 1 in the environment of an internal combustion engine having a block 10 and in which the heat exchanger serves as an oil cooler 12 for lubricating oil for the engine. An oil filter 14 is secured to the oil cooler 12 and the latter additionally has coolant inlet and outlet lines 16 and 18 extending to the cooling system of the engine.

Lubricating oil is directed to the oil cooler 12 via a passage 20 in the block and return lubricating oil is received by the engine via a passage 22.

Figure 2:
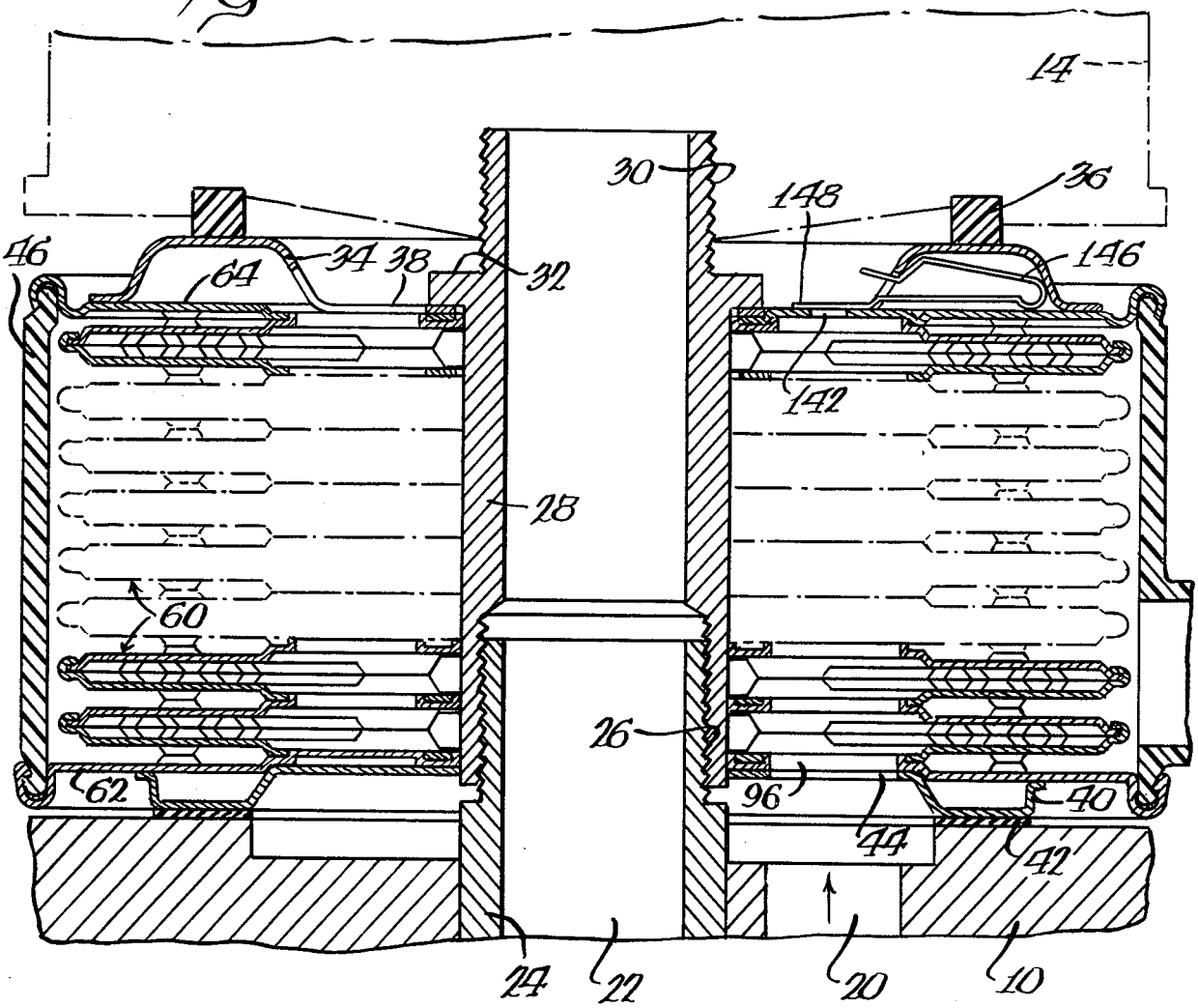
FIG. 2 is an enlarged, sectional view of the heat exchanger mounted on an engine block with a portion of the oil filter shown in dotted lines.

Turning now to FIG. 2, the passage 22 is defined by a sleeve 24 fixedly attached to the engine block 10 and terminating in a threaded end 26 which in turn receives an internally threaded extender 28 inserted through the central opening of the oil cooler 12. The extender 28 includes an exterior collar 32 having wrench flats which bear against a portion of a generally conventional dome plate 34 when tightened to the desired torque for sealably locking the oil cooler 12 to the engine block 10. The extender 28 also includes an externally threaded end 30, adjacent to collar 32, to which in turn the oil filter 14 is connected in a conventional fashion. As seen in dotted lines in FIG. 2, the body of the oil filter 14 carries a conventional gasket or O-ring seal 36 which seals against the dome plate 34.

The end of the oil cooler 12 opposite the dome plate 34 is provided with a generally conventional gasket plate 40 or O-ring plate mounting a gasket 42 or O-ring which sealingly engages the engine block 10. Radially inwardly of the gasket 42, the plate 40 includes an inlet aperture 44 through which lubricating oil enters the interior of the oil cooler.

Oil may exit the oil cooler 12 via a passage 38 in the dome plate 34 to enter the filter 14, be filtered, and then returned to the engine via the extender 28 and the passage 22.

Figure 3:
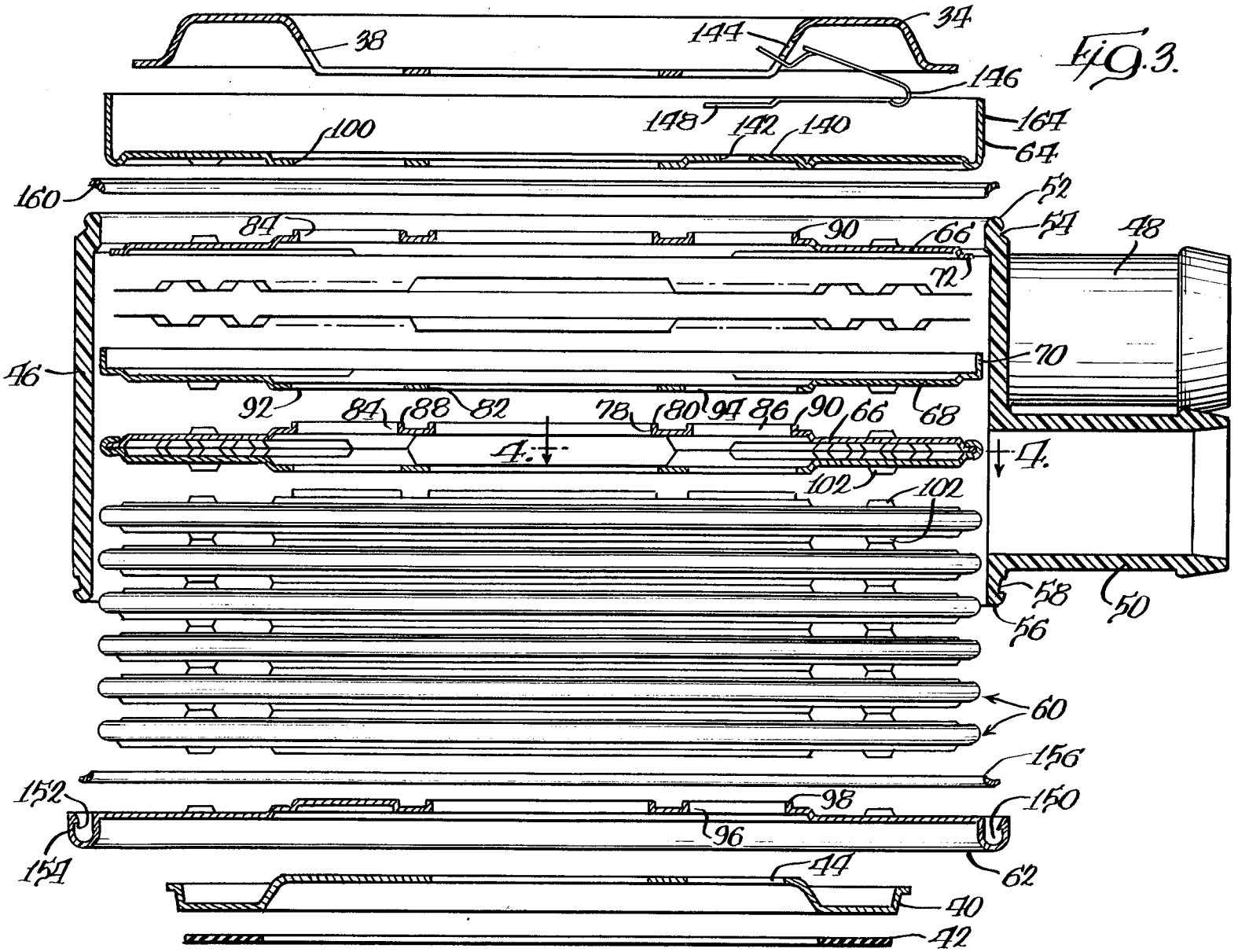
FIG. 3 is an expanded sectional view of the heat exchanger.

The sidewall, or tank 46 of the oil cooler is preferably formed of molded plastic, although in some instances it may be formed of metal, and, as best seen in FIG. 3, includes integral, molded inlet and outlet nipples 48 and 50 for connection to the hoses 16 and 18 whereby coolant may be directed to the interior of the oil cooler 12 and removed therefrom.

The tank 46, as best seen in FIG. 3, has an upper opening terminating in a beaded edge 52 delimited from the remainder of the tank 46 by a groove 54.

The bottom of the tank 46 terminates in an opening parallel to the opening on the upper edge, the bottom opening likewise having a bead 56 delimited from the tank by a groove 58.

Stacked within the tank 46 between the dome plate 34 and the O-ring plate 40 are a plurality of heat exchange units, generally designated 60, and the same are held in place by a lower header 62 and an upper header 64.

Figure 5:
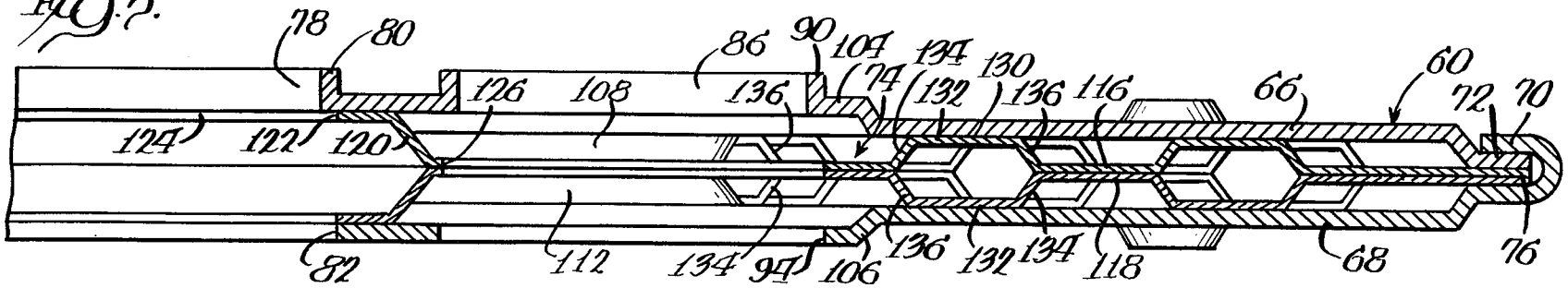
FIG. 5 is a further enlarged sectional view taken approximately along the line 5—5 in FIG. 4.

Reverting to the heat exchange unit 60, each is identical to the other and, as best seen in FIGS. 2, 3 and 5, each includes a metal top plate 66 and a metal bottom plate 68. In the preferred embodiment, the plates 66 and 68 are circular in configuration and, as seen in FIG. 3, the outer peripheral edge of the bottom plate includes, prior to assembly to the top plate 66, an axially extending, peripheral flange 70 which, during assembly, is clinched over the peripheral edge 72 of the top plate as seen in FIG. 5 to hold the assemblage together. Prior to such clinching, however, a turbulator structure, generally designated 74, to be described in greater detail hereinafter, and also formed of circular metallic plates as will be seen, is disposed between the top and bottom plates 66 and 68 so that its peripheral edge 76 is likewise clinched between the top and bottom plates 66 and 68. As is well known, the clinching, in addition to holding the assemblage together, serves to seal the interface of the plates 66 and 68 and the turbulator structure 74.

As perhaps best seen in FIGS. 2 and 3, with additional reference to FIG. 5, each top plate 66 includes a central opening 78 having a radially directed flange 80 while each bottom plate 68 includes a central opening 82 of a diameter to snugly receive the flange 80 on the adjacent plate 66 in the stack.

Additionally, on opposite sides of the central openings 78 and 82, each upper plate includes opposed openings 84 and 86 which likewise are provided with axially extending flanges 88 and 90 for receipt in aligned openings 92 and 94 in the immediate adjacent bottom plate 68.

The aligned ones of the openings 78 and 82 in the plates receive the sleeve 24 or the extender 28 as the case may be while the aligned ones of the openings 86 and 94 in the top and bottom plates 66 and 68 are aligned with a similar opening 96 in the bottom header 62 and the opening 44 in the O-ring plate 40. Thus, such alignment of openings provides a flow passage for the input of oil to be cooled into the heat exchanger. It will be observed that the opening 96 (FIG. 3) in the bottom header 62 has an axially extending flange 98 which is snugly received in the opening 94 of the immediately adjacent bottom plate 68.

The aligned ones of the openings 84 and 92 in the top and bottom plates 66 and 68 are in turn aligned with an opening 100 in the upper header 64 as seen in FIG. 3, and thus with the opening 38 in the dome plate 34 to provide an exit flow path for oil within the heat exchanger.

To facilitate automated assembly, the plates 66 and the plates 68 are symmetrical about a straight line extending through the centers of the openings just described. Thus, the plates, during the assembly operation, can be aligned with each other in more than one way as opposed to prior art structure which are asymmetrical and which require that there be only one position of alignment of the plates with respect to each other.

As seen in FIGS. 3 and 5, each of the plates 66 and 68 is provided with axially projecting dimples 102. Conventionally, the dimples 102 are angularly spaced about the plates symmetrically and engage the corresponding dimple on the adjacent plate to positively assure desired spacing. Each row of dimples forms a column which prevents the individual plates from sagging or drooping during a subsequent brazing operation. Thus, a superior strength is imparted to the finished cooler.

As can be seen in various figures, particularly FIG. 5, the central area of the plate 66 is embossed axially as at 104. The central area of the bottom plate 68 is similarly embossed as at 106. The embossing is such as to be directed away from the opposite plate in the pair. In other words, each heat exchange unit 60 has an extended center area of greatest thickness which, as seen in FIG. 6, wherein the embossment 104 is shown, encompasses the entirety of the openings 78, 84 and 86.

Figure 6:
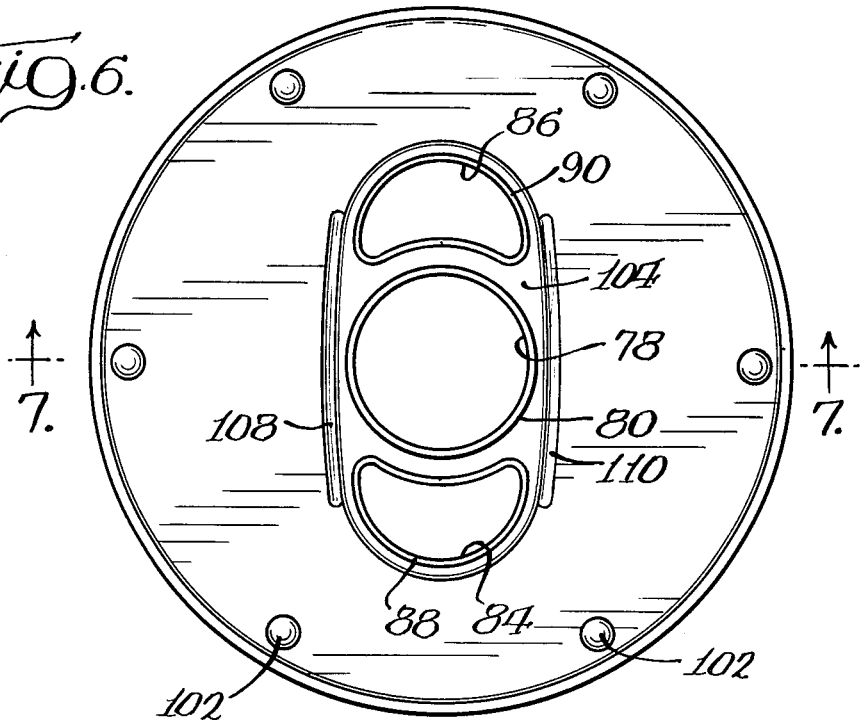
FIG. 6 is a plan view of one plate employed in the heat exchange unit made according to the invention.

FIG. 6 illustrates additional embossments 108 and 110 which are oppositely directed from the embossment 104 but immediately flank the same on opposite sides thereof, extending approximately between the mid points of the openings 86 and 84. Identical embossments (shown in dotted lines at 112 and 114 in FIG. 4) flank the embossment 106 and the bottom plate 68 and extend axially toward the associated top plate 66 in the pair of plates defining each heat exchange unit 60. The purpose of such embossments will be described hereinafter.

Returning now to the turbulator structure 74, the same is defined by two thin fins 116 and 118 (FIG. 5) of metallic material. Each fin 116 and 118 is identical to the other and they are placed in back to back relationship between the plates 66 and 68 as illustrated.

Because each of the fins 116 and 118 is identical to the other, only the fin 116 will be described in detail. The same includes a central embossment 120 terminating in a radially inwardly directed flange 122 defining an opening 124 which is in alignment with the central openings 78 and 82 in the upper and lower plates 66 and 68. The arrangement is such that the flange 122 contacts, in sealing relation after assembly, the abutting portion of the embossment 104 or 106 of the plates 66 and 68.

On opposite sides of the opening 124, each fin 116 includes openings 126 which are aligned with corresponding ones of the aligned openings 86 and 94 and the aligned openings 84 and 92 in the plates 66 and 68 to provide continuity in the flow paths mentioned earlier.

Each fin further includes side by side, half staggered, slit-formed turbulator strands 130. Each turbulator strand 130 includes a top 132 in engagement with the corresponding one of the plates 66 or 68 and two diagonally extending sides 134 and 136 which connect the top 130 to the main body of the corresponding fin. The alternating, half staggered formation can best be appreciated from a consideration of FIGS. 4 and 5.

Because the turbulator strands 130 alternate in a staggered configuration, the main body of the fins 116 and 118 creates what may be termed ties or webs which join adjacent ones of the strands 130 much like a backbone. In a brazing operation employed in the assembly of the heat exchanger, as will be described hereinafter, these ties or webs act as wicks which draw the molten brazing metal to each of the strands 130. Consequently, this assures that the tops 132 of each turbulator strand 130 will braze to the adjacent one of the plates 66 or 68, as the case may be.

Figure 4:
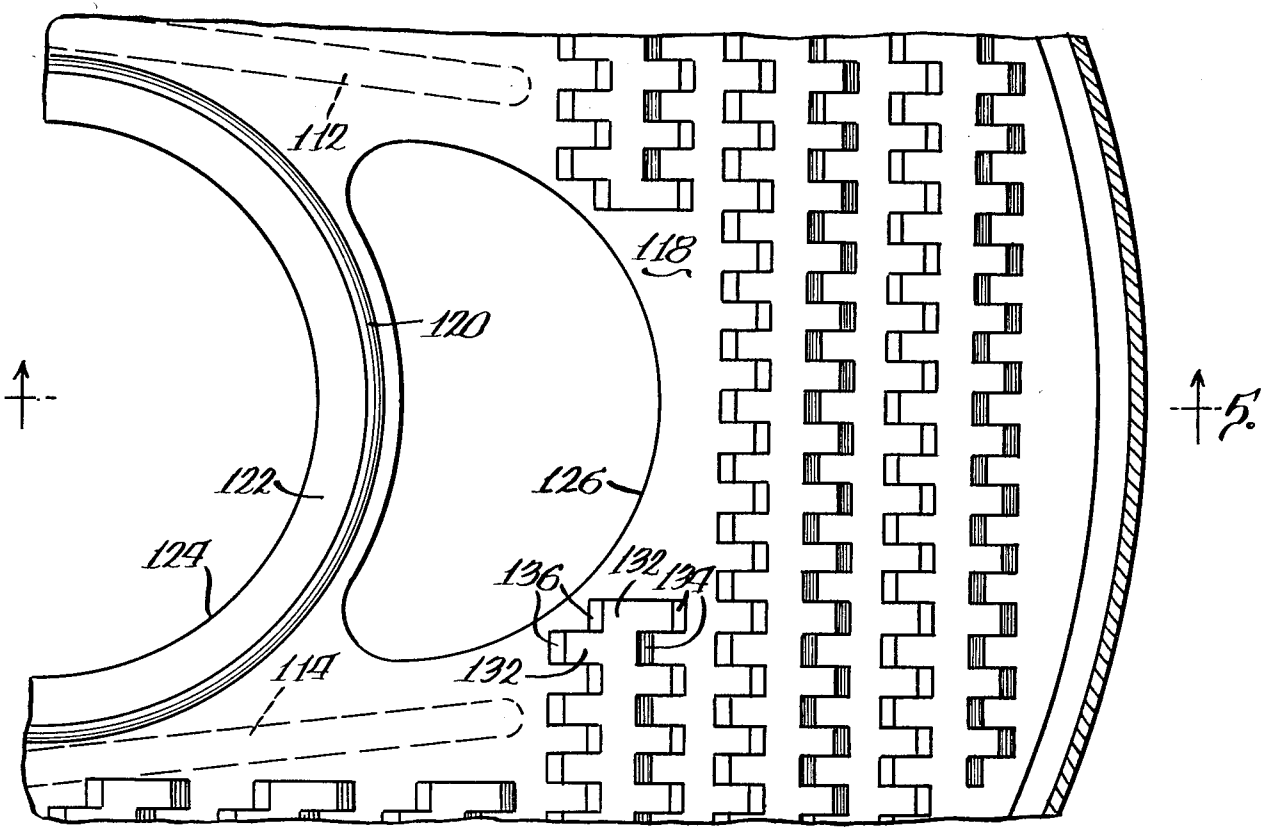
FIG. 4 is an enlarged sectional view taken approximately along the line 4—4 in FIG. 3.
Figure 7:
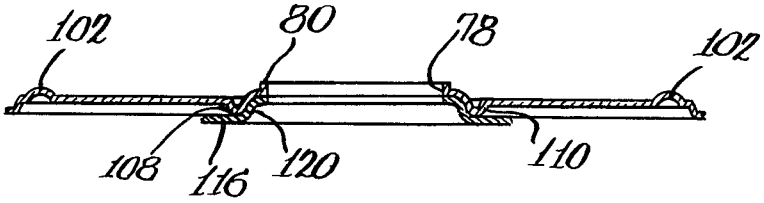
FIG. 7 is a sectional view taken approximately along the line 7—7 in FIG. 6 with the addition of a fragmentary portion of a tubulator structure.
Figure 8:
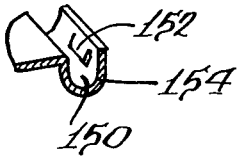
FIG. 8 is a fragmentary view illustrating a tang construction.

The turbulator strands 130 are located about the virtual entirety of each of the fins 116 except for their peripheral edges which are received between the peripheries of the plates 66 and 68 when the flange 70 is clinched over the edge of the plate 66 and in the central area surrounding the apertures 124 and 126 as illustrated in FIG. 4. It will be observed that there is sufficient spacing in such area so as to allow room for the embossments 108, 110, 112 and 114 to nest in abutting relation with the embossments 120 as illustrated in FIG. 7.

Turning now to the upper header 64, the same is provided with an embossment 140 containing a small slot 142. The embossment 140 receives the flange 90 of the immediately lower top plate 66. The dome plate 44 has an adjacent cut-out 144 which receives a spring valve 146 configured as illustrated in FIG. 3. The spring valve 146 includes a valve flapper 148 at one end thereof which normally covers and closes the slot 142 precluding oil from passing therethrough. However, when the oil is at a high viscosity, as when cold, and obviously not in need of further cooling in the heat exchanger, the high viscosity of the oil will cause the valve flapper 148 to open and allow substantial bypass of oil through the heat exchanger directly to the oil filter 114.

Turning now to the lower header 62 (FIG. 3), the same is seen to have an axially directed, peripheral groove 150 provided with a series of hook-like tangs 152 in the outer wall 154 of the groove 150.

An annular gasket or seal 156 is provided for receipt in the groove 150 and a similar gasket 160 is provided to cooperate with the header 64 to establish sealing engagement of the same with the bead 52. The gaskets 156 and 160 may be either pre-formed or formed in place as desired.

Assembly of the heat exchanger may be highly automated and is essentially as follows. The gasket plate 42, the bottom header 62, either heat exchange units 60 with tubulator structures 74 in place, the top header 64 and the dome plate 34 are assembled into a fixture and subjected to furnace brazing. After the brazing process is complete, the structure is subjected to oil side leak tests. Assuming that the structure passes the leak test, the seal 156 is placed in the groove 150 and the tank 146 placed about the subassembly defined by the previous brazing operation. A force is then applied to the top of the tank 46 until the bead 56 enters the groove 50 sufficiently to pass beyond the tangs 152 thereby locking the tank 46 in place. The gasket 160 is then located on the bead 52 and a peripheral, axially extending flange 164 on the upper header 64 is roll clinched about the edge 52 to enter the groove 54. The assembly then appears substantially as illustrated in FIG. 2 and is subject to a further coolant side leak test. If the leak test is passed, the valve 146 is installed and the assembly is complete.

INDUSTRIAL APPLICABILITY

A number of significant advantages accrue from the foregoing. During the assembly operation including the brazing operation, the embossments 104 and 106 on the upper and lower plates 66 and 68 of each heat exchange unit sealingly bond to the corresponding embossment on adjacent units and to the embossments 120 on the turbulator structure 74. As a consequence, it is possible to eliminate oil spacers and water spacers used in prior art designs. This in turn reduces the weight of the assembly and provides increased performance in that the heat sink action of the oil spacers and water spacers is eliminated.

Use of the symmetrical hole pattern in the plates and fins facilitate automated assembly.

The embossments 104 and 106 in the area of the openings 84, 86, 92 and 94 allow smooth transition of oil into the matrix between the plates 66 and 68 of each heat exchange unit 60 occupied by the turbulator structure 74 thereby reducing pressure drop and energy requirements.

Use of axially directed flanges, such as the flanges 88 and 90, make the plates self locating to further facilitate automated assembly.

The use of the embossments 108, 110, 112 and 114 on the plates 66 and 68 in connection with the embossments 120 on the turbulator structure 70 channel oil flow out of a particular port and through the turbulator structure to the opposite port and thereby eliminate bypass flow which would reduce efficiency.

During brazing, the fins 116 and 118 bond together to form a single integral fin as well as bond to the plates 66 and 68 to provide enhanced heat transfer and high unit strength.

The use of a molded plastic tank such as the tank 46 in connection with the beaded edges of the openings thereof and the unique tang structure on the lower header 62 provide for ease of final assembly as well as minimal expense.

I claim:

1. A heat exchanger for exchanging heat between two fluids comprising:

a plurality of heat exchange units in stacked relation, each unit comprising a pair of spaced metallic plates joined together and sealed at their peripheral edges, and a metallic turbulator structure between said plates and in heat exchange relation with both, at least two opposed flow openings disposed about a center opening in each of said plates and said tubulator structure, the openings in each being aligned with the corresponding openings in the other; and embossment means on said plates and said turbulator structure (a) sealing said central opening from said opposed openings and (b) serving as baffles between said plates to direct fluid flowing from one opposed opening to the other through an elongated flow path in said turbulator structure, said embossment means providing means for preventing the flow between said openings from bypassing said turbulator structure; and a housing for said stack including a first inlet sealed to one of said opposed openings, a first outlet sealed to the other of said opposed openings, and second inlets and outlets in fluid communication with the interior of the housing externally of said stack.

2. The heat exchanger of claim 1 wherein each said turbulator structure has oppositely directed embossments about said central opening sealingly engaging adjacent ones of said plates and constituting said embossment means sealing said central opening from said opposed openings.

3. The heat exchanger of claim 2 wherein said turbulator structure comprises two finlike symmetrical plates in back to back relation.

4. The heat exchanger of claim 1 wherein each of said plates has a pair of elongated embossments extending between said opposed openings, the embossments on each plate facing the embossments on the other plate of said pair and engaging said turbulator structure to constitute said embossment means serving as baffles.

5. The heat exchanger of claim 4 wherein each said turbulator structure has oppositely directed embossments about said central opening sealingly engaging adjacent ones of said plates and constituting said embossment means sealing said central opening from said opposed openings; the embossments on said turbulator structure sealingly nesting between and engaging the embossments in each said pair of the adjacent one of said plates.

6. A heat exchanger for exchanging heat between two fluids comprising:

a plurality of heat exchange units in stacked relation, each unit comprising a pair of spaced metallic plates joined together and sealed at their peripheral edges, and each unit having a metallic turbulator structure between said pair of plates and in engagement therewith, the turbulator structure comprising two substantially symmetrical fins, each said fin having a back and a face, said fins being in back to back contact with each other and each having a multiplicity of slit formed strands extending from their respective faces into contact with the adjacent one of said plates; and a housing containing said stack including inlet and outlet means operatively associated with said stack.

7. The heat exchanger of claim 6 wherein said strands are arranged in an alternating partial staggered configuration.

8. The heat exchanger of claim 6 wherein said fins are brazed together with said strands being brazed to the adjacent one of said plates to thereby maximize the heat transfer capability and strength of each said unit.

9. A heat exchanger for exchanging heat between two fluids comprising:

a plurality of heat exchange units in stacked relation, each unit comprising a pair of spaced plates joined together and sealed at their peripheral edges;

means for spacing each of said units from the adjacent unit;

means establishing fluid communication between said units; and a housing containing said stack, said housing having a stack receiving opening, said housing further having an inlet and an outlet;

said opening having an edge defined by a bead;

a cover member for said opening one edge including a peripheral groove facing said bead and having the same configuration thereof so as to be received on said bead;

means securing said cover on said opening with said groove received on said bead, and sealing means in said peripheral groove and sealingly engaging said peripheral groove and said bead.

10. The heat exchanger of claim 9 wherein said securing means comprises a plurality of tangs on one wall of said groove for bitingly engaging said housing about said bead.

11. The heat exchanger of claim 9 wherein said housing contains an additional opening provided with a peripheral bead, and a further cover member for said additional opening, said further cover including a periphery clinched about the bead of said additional opening.

* * * * *